US008752933B2

(12) United States Patent
Kakigahara

(10) Patent No.: US 8,752,933 B2
(45) Date of Patent: Jun. 17, 2014

(54) LIQUID DISCHARGE APPARATUS

(71) Applicant: Yutaka Kakigahara, Nagoya (JP)

(72) Inventor: Yutaka Kakigahara, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/690,696

(22) Filed: Nov. 30, 2012

(65) Prior Publication Data

US 2013/0135386 A1 May 30, 2013

(30) Foreign Application Priority Data

Nov. 30, 2011 (JP) ..... 2011-262963

(51) Int. Cl.
*B41J 2/165* (2006.01)

(52) U.S. Cl.
USPC ..... 347/33

(58) Field of Classification Search
USPC ..... 347/33
See application file for complete search history.

(56) References Cited

U.S. PATENT DOCUMENTS 5,905,513 A * 5/1999 Brandon et al. ..... 347/33
6,168,268 B1 1/2001 Sugiyama
2001/0020963 A1 9/2001 Fukushima et al.
2004/0113973 A1 6/2004 Nakashima
2009/0284561 A1 11/2009 Fukui
2009/0289992 A1* 11/2009 Kawabata ..... 347/33

FOREIGN PATENT DOCUMENTS

JP H11-254707 A 9/1999
JP 2001-018402 * 1/2001 ..... B41J 2/165
JP 2004-114406 A 4/2004
JP 2005-288827 A 10/2005
JP 2009-101594 A 5/2009
JP 2009-274272 A 11/2009

* cited by examiner

*Primary Examiner* — Alessandro Amari
*Assistant Examiner* — Michael Konczal
(74) *Attorney, Agent, or Firm* — Baker Botts L.L.P.

(57) ABSTRACT

A liquid discharge apparatus includes a discharge head including a discharge surface, a receiving surface which receives discharged liquid, a wiper which wipes the receiving surface, a moving device which moves the wiper, a cleaning device which cleans the wiper, and a control device which controls the moving device to move the wiper while contacting the receiving surface, from a wiping start position at one end of the receiving surface to a wiping end position at the other end and to move the wiper from a cleaning position to the wiping start position. The cleaning position is located at an opposite side to the wiping end position with respect to the wiping start position, and a distance from the cleaning position to the wiping start position is smaller than a distance from the wiping end position to the wiping start position.

8 Claims, 9 Drawing Sheets

LIQUID DISCHARGE APPARATUS

CROSS-REFERENCE TO RELATED APPLICATION

This application claims priority from Japanese Patent Application No. 2011-262963, filed on Nov. 30, 2011, the entire subject matter of which is incorporated herein by reference.

TECHNICAL FIELD

Aspects of the present invention relate to a liquid discharge apparatus which discharges ink for recording an image to a recording medium.

BACKGROUND

A known inkjet recording apparatus includes an ink head which discharges ink for recording an image to a recording medium, a head cap which seals a discharge surface of the ink head at a maintenance operation, and a wiper blade which wipes off ink attached on a bottom part of the head cap at the maintenance operation. In the inkjet recording apparatus, a wiper unit accommodating part is arranged at one end side of the head cap, a retreat recess having a scraping wall is arranged at the other end side of the head cap, and the scraping wall is provided with an ink absorbing member. At the maintenance operation, the wiper blade accommodated in the wiper unit accommodating part is moved from one end of the head cap toward the other end, and the ink attached on the bottom part of the head cap is wiped off by the wiper blade. When the operation of wiping off the ink by the wiper blade ends, the wiper blade is cleaned with the ink absorbing member while the wiper blade overrides the scraping wall. Then, the wiper blade is stopped in the retreat recess. When a second wiping operation is performed after the first wiping operation ends, the wiper blade is returned to the one end side of the head cap.

SUMMARY

According to the above-described inkjet recording apparatus, the scraping wall and the ink absorbing member are arranged in the vicinity of a wiping end position which is located at the other end side of the head cap. Therefore, when starting the wiping operation, the wiper blade which has been cleaned with the ink absorbing member has to be moved to a wiping start position which is located at the one end side of the head cap. Therefore, during the movement of the wiper blade, the ink may be again attached to the cleaned wiper blade, so that a wiping performance may be deteriorated.

Accordingly, an aspect of the present invention provides a liquid discharge apparatus capable of preventing liquid from being attached to a cleaned wiper to thus prevent deterioration of a wiping performance.

According to an illustrative embodiment of the present invention, there is provided a liquid discharge apparatus including a liquid discharge apparatus includes a liquid discharge head, a liquid receiving surface, a first wiper, a moving device, a cleaning device, and a control device. The liquid discharge head includes a discharge surface having a plurality of liquid discharge nozzles formed thereon. The liquid receiving surface is configured to oppose the discharge surface to receive liquid discharged from the liquid discharge nozzles. The first wiper is configured to wipe liquid attached on the liquid receiving surface while being moved with contacting the liquid receiving surface. The moving device is configured to move the first wiper. The cleaning device is configured to clean the first wiper. The control device is configured to control the moving device to move the first wiper while contacting the liquid receiving surface, from a first wiping start position which is located at one end of the liquid receiving surface to a first wiping end position which is located at the other end opposite to the one end of the liquid receiving surface, to move the first wiper from the first wiping end position to a wiper cleaning position defined by the cleaning device, and to move the first wiper from the wiper cleaning position to the first wiping start position. The wiper cleaning position is aligned in a predetermined direction together with the first wiping start position and the first wiping end position and is located at an opposite side to the first wiping end position with respect to the first wiping start position, and a distance from the wiper cleaning position to the first wiping start position is smaller than a distance from the first wiping end position to the first wiping start position.

According to the above configuration, it is possible to clean the first wiper by the cleaning device just before starting a first wiping operation. Therefore, it is possible to reduce a possibility that the liquid is again attached to the first wiper until the first wiping operation of the first wiper starts after the first wiper is cleaned. Hence, it is possible to prevent the deterioration of the wiping performance.

According to the above configuration, it is possible to prevent liquid from being again attached to the cleaned wiper and to thus prevent the deterioration of the wiping performance.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of a liquid discharge apparatus will be described with reference to the drawings. In the below illustrative embodiments, an inkjet printer is illustrated as an example of the liquid discharge apparatus, and ink is used as an example of a liquid. In another illustrative embodiment, a process liquid which modifies a surface of a recording medium may be used as the liquid.

Figure 1:
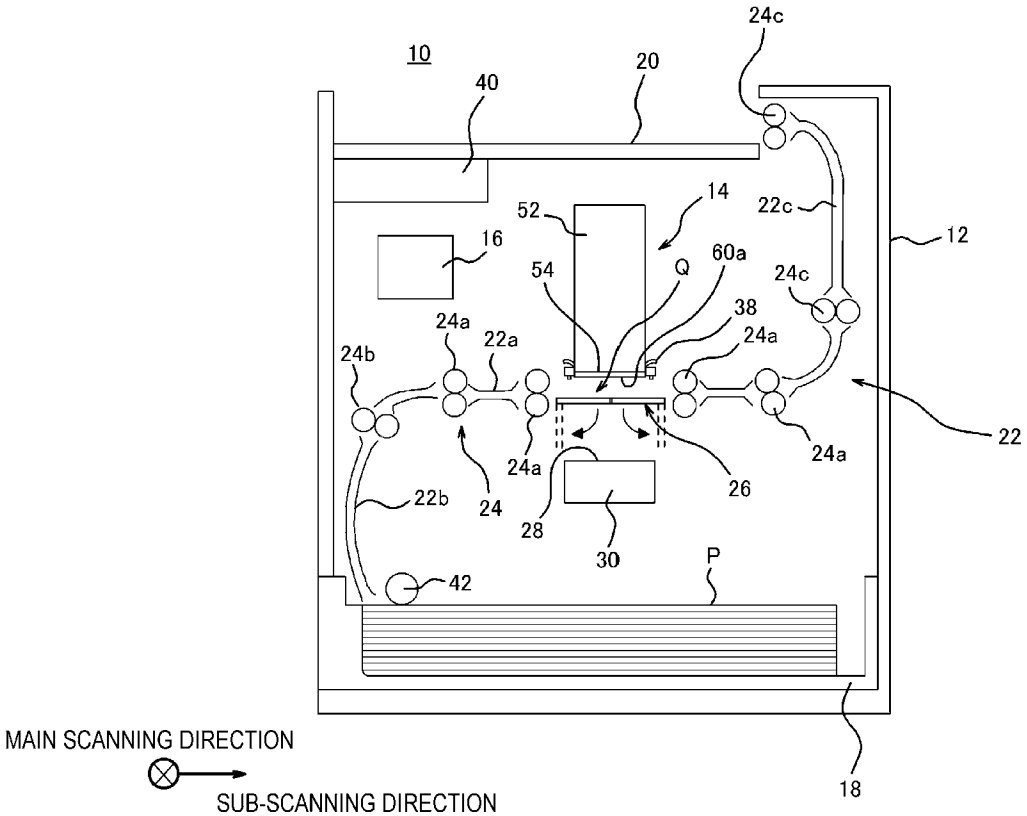
FIG. 1 is a schematic side view showing an overall configuration of an inkjet printer according to an illustrative embodiment of the invention.
Figure 2:
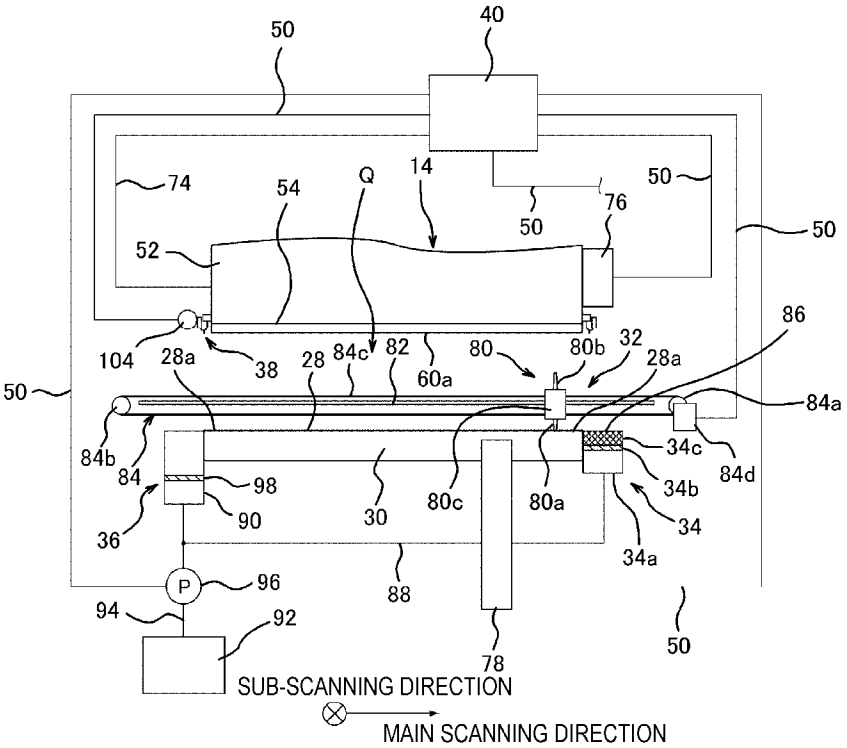
FIG. 2 is a schematic view showing a configuration of a portion of the inkjet printer.

FIG. 1 is a schematic view showing an overall configuration of an inkjet printer 10 according to an illustrative embodiment of the invention, and FIG. 2 is a schematic view showing a configuration of a portion of the inkjet printer 10. As shown in FIG. 1, the inkjet printer 10 is configured to record an image on a sheet P in a predetermined recording area Q and includes a housing 12, an ink discharge head 14 (an example of a liquid discharge head) having a discharge surface 60*a* in which ink discharge nozzles 60 (refer to FIG. 6) are formed, an ink tank 16 which accommodates therein ink, a sheet accommodating unit 18 which accommodates therein sheets P, and a sheet discharge part 20 which receives a sheet P having an image formed thereon by the ink discharge head 14.

Also, as shown in FIG. 1, the inkjet printer 10 includes a conveyance path 22 for conveying the sheet P from the sheet accommodating unit 18 to the sheet discharge part 20 via the predetermined recording area Q, a conveyance force applying unit 24 which applies a conveyance force for conveying the sheet P through the conveyance path 22 to the sheet P, and a platen 26 which is provided on the conveyance path 22 and supports the sheet P in the predetermined recording area Q.

Also, as shown in FIG. 2, the inkjet printer 10 includes an ink receiving member 30 (an example of a liquid receiving member) having an ink receiving surface 28 (an example of a liquid receiving surface) which is capable of opposing the discharge surface 60*a* to receive the ink discharged from the nozzles 60 (refer to FIG. 6) of the ink discharge head 14, a wiping unit 32 which wipes off the ink attached on the discharge surface 60*a* and the ink receiving surface 28, a cleaning unit 34 which cleans a first wiper 80*a* of the wiping unit 32, an ink disposing unit 36 (an example of a liquid disposing unit) which disposes the ink wiped off by the first wiper 80*a* and ink remaining on the first wiper 80*a*, a cap peripheral wall member 38, and a control unit 40 which executes various control operations.

The control unit 40 includes a CPU, a non-volatile memory which rewritably stores therein programs, which are executed by the CPU, and various data and a RAM which temporarily stores data at execution of the programs. As the programs are executed by the CPU, a variety of processing necessary for image formation are performed. Also, the control unit 40 is connected with a switch (not shown) (an example of a maintenance command unit) which provides the control unit 40 with a maintenance command for execution of a maintenance control. In the meantime, the maintenance command unit may be stored in the non-volatile memory as a program for enabling the control unit 40 to execute the maintenance control at a predetermined timing.

As shown in FIG. 1, the conveyance path 22 has a horizontal path 22*a* for conveying the sheet P in a horizontal direction in the predetermined recording area Q, a feed path 22*b* for conveying the sheet P accommodated in the sheet accommodating unit 18 toward the horizontal path 22*a* and a discharge path 22*c* for conveying the sheet P having passed through the horizontal path 22*a* toward the discharge unit 20.

As shown in FIG. 1, the conveyance force applying unit 24 includes first conveyance rollers 24*a* which apply a conveyance force for conveying the sheet P through the horizontal path 22*a* to the sheet P, second conveyance rollers 24*b* which apply a conveyance force for conveying the sheet P through the feed path 22*b* to the sheet P, third conveyance rollers 24*c* which apply a conveyance force for conveying the sheet P through the discharge path 22*c* to the sheet P, and a pickup roller 42 which picks up the sheet P in the sheet accommodating unit 18 and feeds the same to the feed path 22*b*. The control unit 40 is electrically connected with a driving motor (not shown) which drives the first conveyance rollers 24*a*, the second conveyance rollers 24*b*, the third conveyance rollers 24*c* and the pickup roller 42, respectively, via a conductive line (not shown). In this illustrative embodiment, a substantially center portion of the horizontal path 22*a* in the front-rear direction is arranged in the predetermined recording area Q, and the ink discharge head 14 is arranged above the predetermined recording area Q. A conveyance direction of the sheet P in the predetermined recording area Q is referred to as a 'sub-scanning direction' and a direction orthogonal to the sub-scanning direction is referred to as a 'main scanning direction.'

Figure 3:
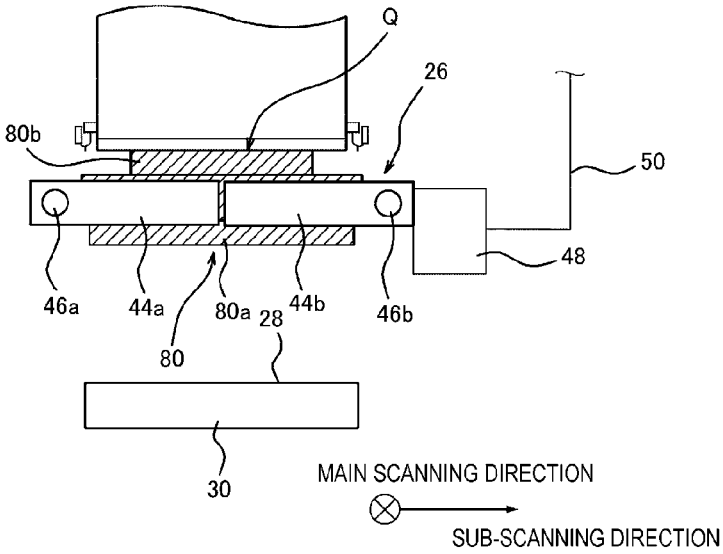
FIG. 3 is a front view showing a state of a platen when recording an image.
Figure 4:
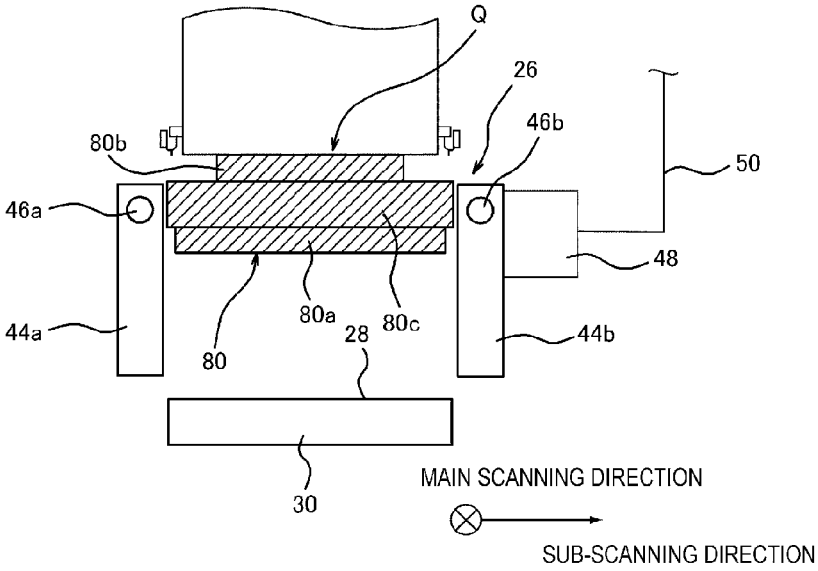
FIG. 4 is a front view showing a state of the platen at a maintenance operation.

FIG. 3 is a front view showing a state of the platen 26 when recording an image, and FIG. 4 is a front view showing a state of the platen 26 at a maintenance operation. As shown in FIGS. 3 and 4, the platen 26 has two plate-shaped door members 44*a*, 44*b* having a substantially rectangular shape, which are opened and closed like a door. The two door members 44*a*, 44*b* are arranged in order from an upstream side of the conveyance direction (sub-scanning direction) of the sheet P and extend in the main scanning direction. An upstream-side end portion of the upstream-side door member 44*a* is rotatably supported by a rotational shaft 46*a* extending in the main scanning direction, and a downstream-side end portion of the downstream-side door member 44*b* is rotatably supported by a rotational shaft 46*b* extending in the main scanning direction. Also, the platen 26 is connected with a platen driving device 48 for opening and closing the door members 44*a*, 44*b*, and the platen driving device 48 is electrically connected with the control unit 40 (refer to FIG. 1) via a conductive line 50.

Figure 5:
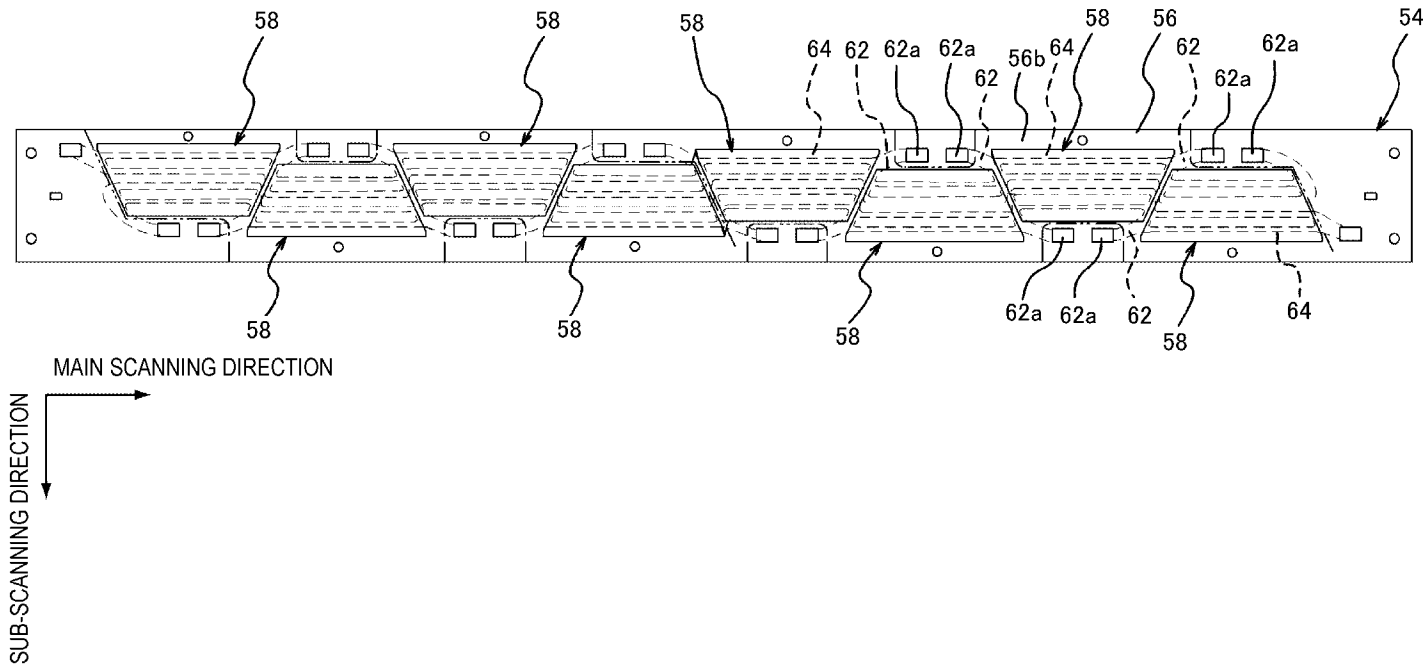
FIG. 5 is a plan view showing a configuration of a head part of an ink discharge head.
Figure 6:
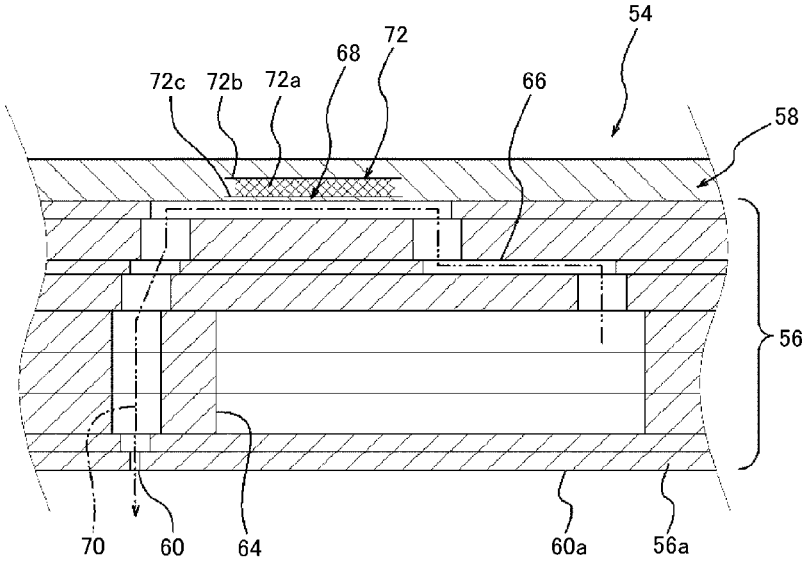
FIG. 6 is a partially enlarged section view showing a configuration of the head part of the ink discharge head.

FIG. 5 is a plan view showing a configuration of a head part 54 of the ink discharge head 14 (refer to FIG. 1), and FIG. 6 is a partially enlarged section view showing a configuration of the head part 54. The inkjet printer 10 shown in FIG. 1 is a line-type printer and the ink discharge head 14 (refer to FIG. 1) is provided to extend horizontally in the main scanning direction.

As shown in FIG. 1, the ink discharge head 14 includes a head holder 52 having a substantially rectangular parallelepiped shape and extending in the main scanning direction, and a head part 54 provided on a lower surface of the head holder 52 and extending in the main scanning direction. As shown in FIGS. 5 and 6, the head part 54 includes one flow path unit 56 and a plurality of actuators 58 (eight actuators, in this illustrative embodiment) jointed to an upper surface thereof. As shown in FIG. 6, the flow path unit 56 is a laminated member having a plurality of metal plates, and a lower surface of a nozzle plate 56*a* configuring the lowest layer is the discharge surface 60*a* having a plurality of nozzles 60 formed therein. Also, as shown in FIG. 6, the flow path unit 56 is formed therein with a manifold 62 (refer to FIG. 5), a sub-manifold 64 communicating with the manifold 62 (refer to FIG. 5), and a plurality of individual ink flow paths 70 each of which extending from the sub-manifold 64 to the nozzle 60 via an aperture 66 and a pressure chamber 68. As shown in FIG. 5, an upper surface 56*b* of the flow path unit 56 is formed with a plurality of ink supply ports 62*a* communicating with the manifold 62.

As shown in FIG. 5, each actuator 58 has a substantially trapezoidal shape, when seen from a plan view, and the actuators 58 adjacent to each other are arranged in a line in the main scanning direction such that upper and lower bottoms thereof are positioned in a reverse direction. As shown in FIG. 6, the respective actuators 58 have a plurality of driving parts 72 (which is shown in a grid line in FIG. 6) corresponding to the pressure chamber 68. Each of the driving parts 72 has a piezoelectric layer 72*a* and a pair of electrodes 72*b*, 72*c* arranged to sandwich the piezoelectric layer therebetween. As shown in FIG. 2, the driving parts 72 (refer to FIG. 6) are electrically connected with the control unit 40, respectively, via a flexible wiring board 74 having a driver IC (not shown) mounted thereon.

When a driving voltage (for example, a potential difference of 28V) is supplied between the electrodes 72*b*, 72*c* of the driving part 72, the piezoelectric layer 72*a* is contracted in a direction orthogonal to a thickness direction. Thereby, a part positioned below the piezoelectric layer 72*a* is deformed to be convex toward an inside of the pressure chamber 68, so that a volume of the pressure chamber 68 is reduced. This state is called as a basic state. At the basic state, when a ground voltage (for example, a potential difference of 0V) is supplied between the electrodes 72*b*, 72*c*, the contracted state of the piezoelectric layer 72*a* is released. Thus, the volume of the pressure chamber 68 is returned to its original size, so that the volume of the pressure chamber 68 is increased. When the ground voltage is instantaneously supplied between the electrodes 72*b*, 72*c* at a state where the basic state is kept, the volume of the pressure chamber 68 is instantaneously varied in response to a magnitude of the driving voltage at timing at which the ground voltage is supplied, so that a discharge energy is applied to the ink existing in the pressure chamber 68. By the discharge energy, the ink is discharged from the nozzles 60. In the meantime, the driving method of the ink discharge head 14 may be appropriately changed.

As shown in FIG. 2, the head holder 52 of the ink discharge head 14 is connected with a head elevating device 76 for moving up and down the ink discharge head 14, and the head elevating device 76 is electrically connected with the control unit 40 via the conductive line 50. In this illustrative embodiment, the head elevating device 76 is driven by the control unit 40, so that it is possible to vertically move the discharge surface 60*a* between a first head position H1 (refer to FIG. 7) at which the discharge surface 60*a* is located when recording an image on the sheet P and a second head position H2 (refer to FIG. 9) above the first head position H1. In this illustrative embodiment, a predetermined position on one end of the discharge surface 60*a* in the main scanning direction is a second wiping start position Q1 (refer to FIG. 10) and a predetermined position on the other end opposite to the one end of the discharge surface 60*a* in the main scanning direction is a second wiping end position Q2 (refer to FIG. 10).

As shown in FIG. 2, the ink receiving member 30 having a substantial plate shape which receives the ink discharged from the nozzles 60 (refer to FIG. 6) of the ink discharge head 14 at the maintenance operation. The ink receiving surface 28 which is an upper surface of the ink receiving member 30 is made of glass or metal (SUS and the like) which does not absorb liquid or absorbs little liquid so as to easily wipe off the ink by the first wiper 80*a* and has a substantially rectangular shape, when seen from the plan view. When seeing the ink discharge head 14 and the ink receiving surface 28 at the same time from the plan view, a periphery of the ink receiving surface 28 protrudes from the discharge surface 60*a* of the ink discharge head 14. The protruding part is a contact surface 28*a* with which a lower end portion of the cap peripheral wall member 38 is brought into contact. A length of the ink receiving surface 28 in the main scanning direction is substantially longer than a length of the ink receiving surface 28 in the sub-scanning direction, a predetermined position on one end of the ink receiving surface 28 in the main scanning direction is a first wiping start position P1 (refer to FIG. 12) and a predetermined position on the other end opposite to the one end of the ink receiving surface 28 in the main scanning direction is a first wiping end position P2 (refer to FIG. 12).

As shown in FIG. 2, the ink receiving member 30 is connected with an elevating device 78 for moving up and down the ink receiving member 30, and the elevating device 78 is electrically connected with the control unit 40 via the conductive line 50. In this illustrative embodiment, the elevating device 78 is driven by the control unit 40, so that it is possible to vertically move the ink receiving surface 28 among a first ink receiving surface position L1 (refer to FIG. 7) at which the ink receiving surface 28 is located when recording an image, a second ink receiving surface position L2 (refer to FIG. 12) at which the ink receiving surface 28 is located when wiping the ink receiving surface 28, a third ink receiving surface position L3 (refer to FIG. 9) above the first ink receiving surface position L1 and below the second ink receiving surface position L2 and a capping position L4 (refer to FIG. 14). Thereby, it is possible to cause the ink receiving surface 28 to oppose the discharge surface 60*a* at the maintenance operation.

As shown in FIG. 2, the wiping unit 32 has a wiper unit 80, a guide 82 having a substantial rod shape guiding the wiper unit 80 in the main scanning direction and a moving unit 84 moving the wiper unit 80 along the guide 82.

As shown in FIG. 2, the wiper unit 80 has the first wiper 80*a* which wipes off the ink attached on the ink receiving surface 28 while being moved with contacting the ink receiving surface 28, the second wiper 80*b* which wipes off the ink attached on the discharge surface 60*a* while being moved with contacting the discharge surface 60*a*, and a base part 80*c* which supports the first and second wipers 80*a*, 80*b*. The first wiper 80*a* has a substantial plate shape and is made of an elastic material such as rubber, and a length of the first wiper 80*a* is longer than a length of the ink receiving surface 29 in the sub-scanning direction. The second wiper 80*b* has a substantial plate shape and is made of an elastic material such as rubber, and a length of the second wiper 80*b* is longer than a length of the discharge surface 60*a* in the sub-scanning direction. The base part 80*c* has a substantial rod shape and extending in the sub-scanning direction. The first wiper 80*a* protrudes downward from a lower part of the base part 80*c* and the second wiper 80*b* protrudes upward from an upper part of the base part 80*c*. That is, the second wiper 80*b* is configured to be moved together with the first wiper 80*a*. The base part 80*c* is supported to the guide 82 to be freely slidable in the main scanning direction.

As shown in FIG. 2, the moving unit 84 has a pair of pulleys 84*a*, 84*b* which are arranged at an interval in the main scanning direction, an annular endless belt 84*c* which is wound around the pulleys 84*a*, 84*b*, and a motor 84*d* which rotates the pulley 84*a*. The base part 80*c* of the wiper unit 80 is fixed to the endless belt 84*c*. The motor 84*d* is electrically connected with the control unit 40 via the conductive line 50.

As shown in FIG. 2, the cleaning unit 34 is configured to clean the first wiper 80*a* and defines a wiper cleaning position P3 (refer to FIG. 11) at which the first wiper 80*a* is located when cleaning the first wiper 80*a*. The cleaning unit 34 includes a negative pressure chamber 34*a*, a cap tip 34*b* which is substantially horizontally arranged in the negative pressure chamber 34*a*, and an ink absorbing member 34*c* which has a contact surface 86 contacting the first wiper 80*a* and is arranged above the cap tip 34*b* in the negative pressure chamber 34*a*. As shown in FIG. 12, the wiper cleaning position P3 is aligned in a predetermined direction (main scanning direction, in this illustrative embodiment) together with the first wiping start position P1 and the first wiping end position P2, is located at an opposite side to the first wiping end position P2 with respect to the first wiping start position P1, and a distance from the wiper cleaning position P3 to the first wiping start position P1 is smaller than a distance from the first wiping end position P2 to the first wiping start position P1.

As shown in FIG. 2, the negative pressure chamber 34*a* has a substantial housing shape and is configured to generate a negative pressure. A bottom part of the negative pressure chamber 34*a* is connected with a second pipe 88 of the ink disposing unit 36. The second pipe 88 is connected with a vacuum pump 96 via a first pipe 94. The negative pressure chamber 34*a* is integrally formed at one end of the ink receiving member 30 and is moved up and down together with the ink receiving member 30. The cap tip 34*b* is a member having a substantial plate shape for efficiently applying a negative pressure to a predetermined area of the upper part thereof, and a part of the cap tip 34*a* corresponding to the predetermined area is formed with at least one through-hole (not shown). The ink absorbing member 34*c* is configured to contact the first wiper 80*a* and to thus absorb the ink attached on the first wiper 80*a* by the contact surface 86. At least the contact surface 86 of the ink absorbing member 34*c* has a mesh shape capable of absorbing the ink by the capillary action. Regarding the material configuring the contact surface 86, an experiment has shown that it is advantageous to use metal (wire net), although the invention is not particularly limited thereto.

Figure 14:
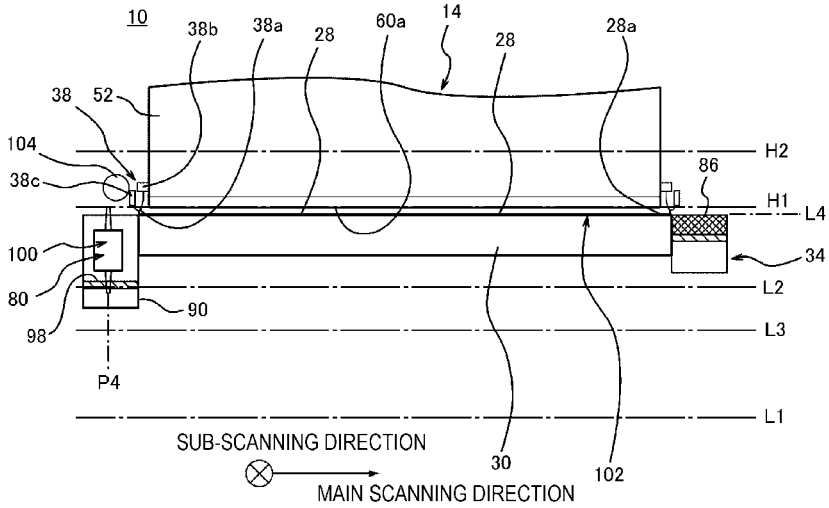
FIG. 14 shows a state of the inkjet printer when the discharge surface is covered by a cap.

As shown in FIG. 2, the ink disposing unit 36 is configured to dispose the ink wiped off by the first wiper 80*a* and includes an ink receiving port 90 (an example of a liquid receiving port) allowing the ink received by the ink receiving surface 29 to flow therein, a waste ink accommodating chamber 92 (an example of a waste liquid accommodating chamber) which accommodates therein waste ink, the first pipe 94 allowing the ink receiving port 90 and the waste ink accommodating chamber 92 to communicate with each other, and the vacuum pump 96 which causes the ink in the waste ink receiving port 90 to flow to the waste ink accommodating chamber 92 via the first pipe 94. Also, the ink disposing unit 36 includes the second pipe 88 allowing the negative pressure chamber 34*a* of the cleaning unit 34 and a middle part of the first pipe 94 to communicate with each other. The vacuum pump 96 is provided at a side closer to the waste ink accommodating chamber 92 than the middle part of the first pipe 94. The vacuum pump 96 is electrically connected with the control unit 40 via the conductive line 50.ffirst As shown in FIG. 2, the ink receiving port 90 is configured to allow the ink wiped off by the first wiper 80*a* to flow therein and to define an ink disposal position P4 (refer to FIG. 14) (an example of a liquid disposal position) at which the first wiper 80*a* is located when causing the ink to flow therein. Also, the ink receiving port 90 has a substantial housing shape with an opened upper surface. In the ink receiving port 90, a cap tip 98 having a substantial plate shape formed with at least one through-hole (not shown) is arranged. As shown in FIG. 14, a wiper unit accommodating part 100 which accommodates the wiper unit 80 is provided above the cap tip 98 in the ink receiving port 90. When the discharge surface 60*a* is covered by a cap 102, the wiper unit 80 is accommodated in the wiper unit accommodating part 100. The ink receiving port 90 is integrally formed at the other end of the ink receiving member 30 and is moved up and down together with the ink receiving member 30. As shown in FIG. 12, the ink disposal position P4 is aligned in a predetermined direction (main scanning direction, in this illustrative embodiment) together with the first wiping start position P1, the first wiping end position P2 and the wiper cleaning position P3, and is located at an opposite side to the first wiping start position P1 with respect to the first wiping end position P2, and a distance from the ink disposal position P4 to the first wiping end position P2 is smaller than a distance from the first wiping start position P1 to the first wiping end position P2.

As shown in FIG. 14, the cap peripheral wall member 38 configures the cap 102 covering the discharge surface 60*a* in cooperation with the ink receiving surface 28. The cap peripheral wall member 38 includes an annular peripheral wall part 38*a* which is formed of an elastic material such as rubber and is bent to be convex downward, a fixed part 38*b* which is provided at one end of the peripheral wall part 38*a*, and a moveable part 38*c* which is provided at the other end of the peripheral wall part 38*a*. The fixed part 38*b* is jointed to an outer periphery of the head holder 52 of the ink discharge head 14, and the moveable part 38*c* is connected with a peripheral wall elevating device 104. When the moveable part 38*c* is moved up or down by the peripheral wall elevating device 104, the lowest point of the peripheral wall part 38*a* is correspondingly moved up or down. Also, as shown in FIG. 2, the peripheral wall elevating device 104 is electrically connected with the control unit 40 via the conductive line 50. When performing a capping operation, the control unit 40 drives the peripheral wall elevating device 104 to move down the lowest point of the peripheral wall part 38*a*.

The control unit 40 controls the moving unit 84 (refer to FIG. 2) to move the first wiper 80*a* while contacting the ink receiving surface 28 from the first wiping start position P1 which is located at one end of the ink receiving surface 28 to the first wiping end position P2 which is located at the other end opposite to the one end of the ink receiving surface 28, (refer to FIG. 12), to move the first wiper 80*a* from the first wiping end position P2 to the wiper cleaning position P3 (refer to FIG. 11) defined by the cleaning unit 34, and to move the first wiper 80*a* from the wiper cleaning position P3 to the first wiping start position P1 (refer to FIG. 12). In the below, states of the inkjet printer 10 which is controlled by the control unit 40 are described for each process.

Figure 7:
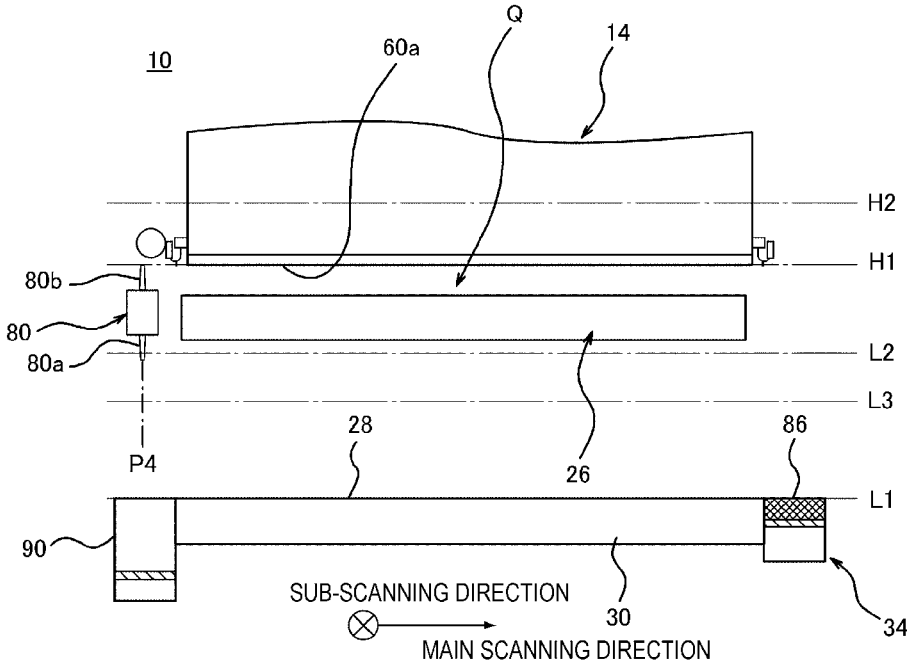
FIG. 7 shows a state of the inkjet printer when a first wiper is located at an ink disposal position at recording of an image.

FIG. 7 shows a state of the inkjet printer 10 when the first wiper 80*a* is located at the ink disposal position P4 at recording of an image. As shown in FIG. 7, when recording an image, i.e., when performing a printing operation, the first wiper 80*a* is located at the ink disposal position P4 and the ink receiving surface 28 is located at the first ink receiving surface position L1. Also, the discharge surface 60*a* is located at the first head position H1. The two door members 44*a*, 44*b* of the platen 26 are closed and the platen 26 is arranged to oppose the discharge surface 60*a*. At this state, the sheet P is fed to the predetermined recording area Q and an image is recorded onto the sheet P by the ink discharge head 14.

Figure 8:
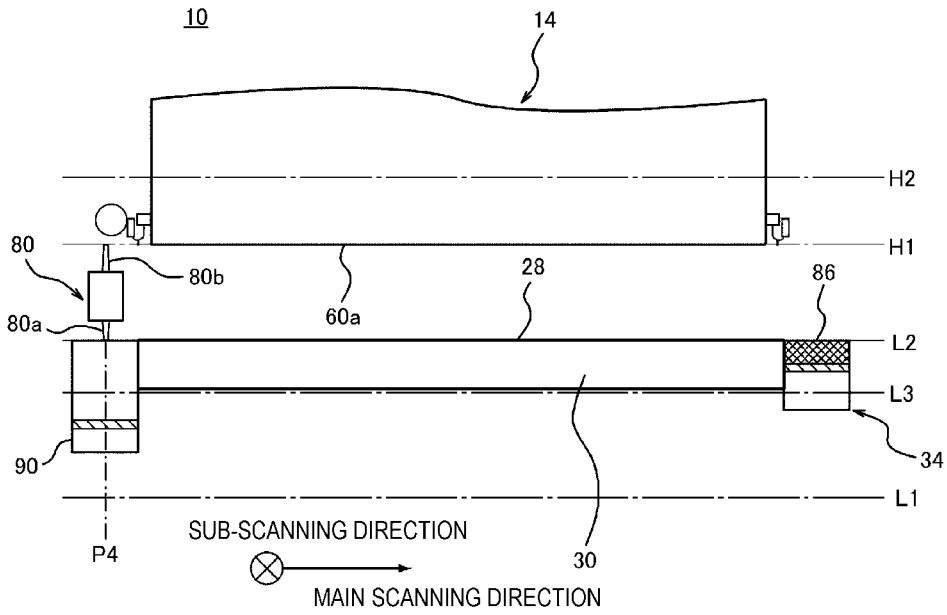
FIG. 8 shows a state of the inkjet printer when forcibly discharging ink.

FIG. 8 shows a state of the inkjet printer 10 when forcibly discharging ink. At the maintenance operation, a forcible ink discharge operation of forcibly discharging the ink in the nozzles 60 is performed. The forcible ink discharge operation includes flushing and purge operations. The flushing operation is an operation of driving the actuators 58 (refer to FIG. 6) of the ink discharge head 14 based on flushing data different from image data, and thus forcibly discharging the ink from the nozzles 60. The purge operation is an operation of applying a pressure to the ink in the ink discharge head 14 by a pump (not shown) and thus forcibly discharging the ink from the nozzles 60.

As shown in FIG. 8, when performing the forcible ink discharge operation, the two door members 44*a*, 44*b* of the platen 26 are opened (refer to FIGS. 3 and 4) and the platen 26 is retreated from the position opposing the discharge surface 60*a*. Also, the first wiper 80*a* is located at the ink disposal position P4 and the ink receiving surface 28 is located at the second ink receiving surface position L2. The actuators 58 (refer to FIG. 6) or pump (not shown) is driven, so that the flushing or purge operation is performed.

Figure 9:
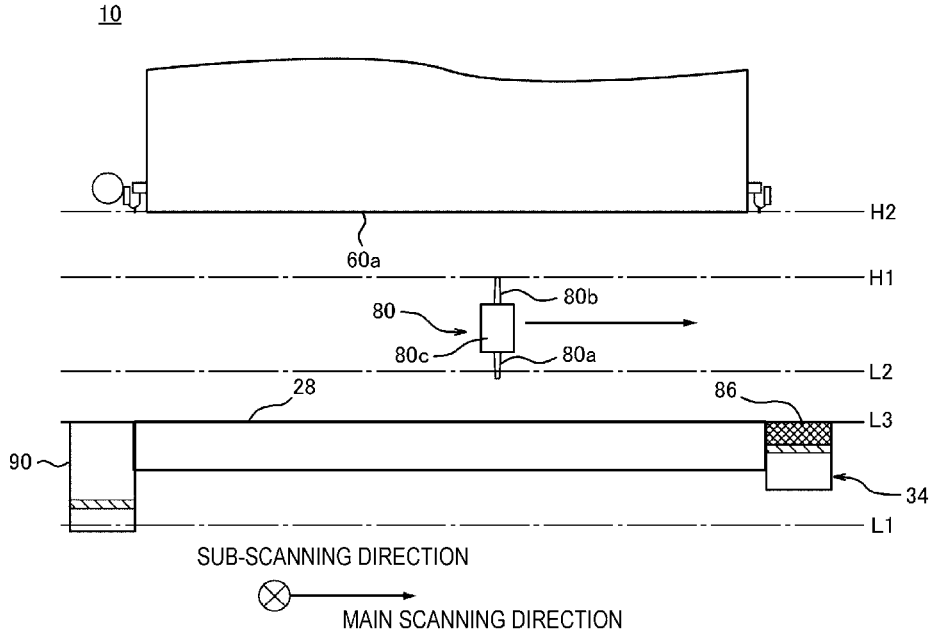
FIG. 9 shows a state of the inkjet printer when moving a wiper unit.

FIG. 9 shows a state of the inkjet printer 10 when moving the wiper unit 80. As shown in FIG. 9, when moving the wiper unit 80, the ink receiving surface 28 is located at the third ink receiving surface position L3 and the discharge surface 60*a* is located at the second head position H2. The wiper unit 80 is moved by the moving unit 84 (refer to FIG. 2).

Figure 10:
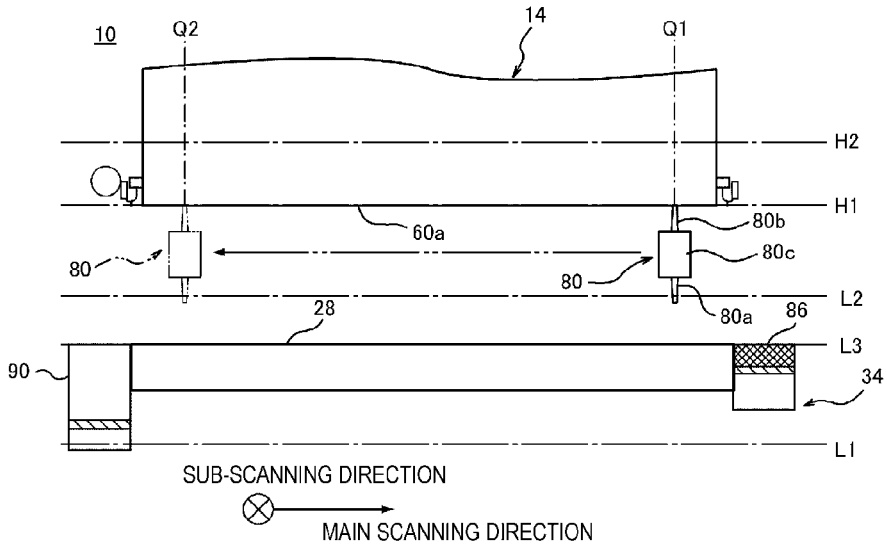
FIG. 10 shows a state of the inkjet printer when wiping off ink attached on a discharge surface by a second wiper.

FIG. 10 shows a state of the inkjet printer 10 when wiping off the ink attached on the discharge surface 60*a* by the second wiper 80*b*. As shown in FIG. 10, when wiping off the ink attached on the discharge surface 60*a* by the second wiper 80*b*, the ink receiving surface 28 is located at the third ink receiving surface position L3 and the discharge surface 60*a* is located at the first head position H1. The wiper unit 80 is moved by the moving unit 84 (refer to FIG. 2), so that the second wiper 80*b* is moved from the second wiping start position Q1 to the second wiping end position Q2 while contacting the discharge surface 60*a*.

Figure 11:
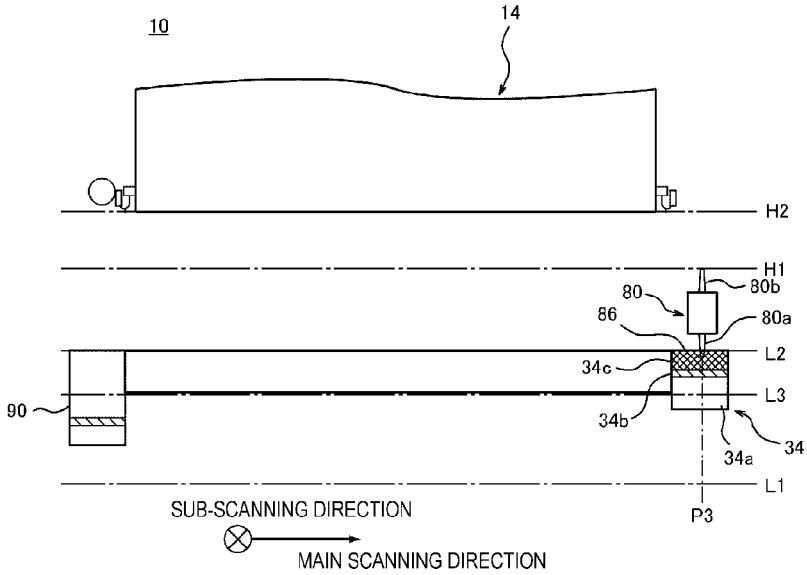
FIG. 11 shows a state of the inkjet printer when the first wiper is located at a wiper cleaning position.
Figure 12:
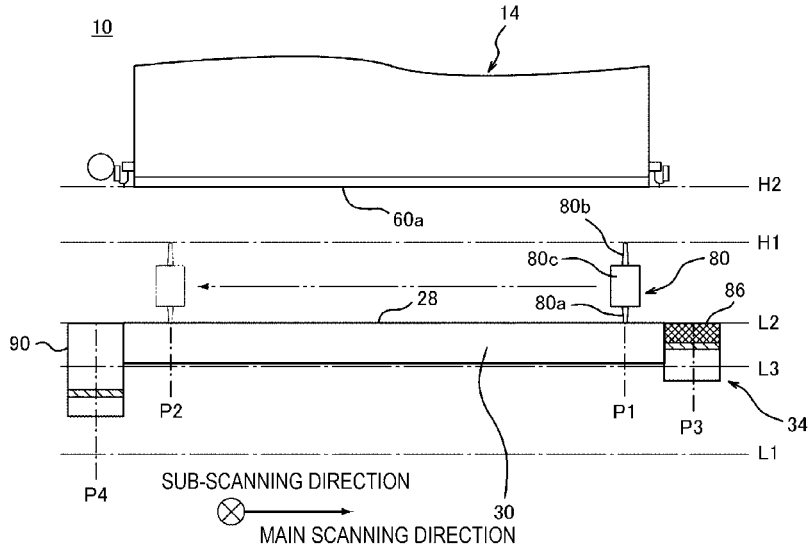
FIG. 12 shows a state of the inkjet printer when wiping off ink attached on an ink receiving surface by the first wiper.

FIG. 11 shows a state of the inkjet printer 10 when the first wiper 80*a* is located at the wiper cleaning position P3. When the ink attached on the discharge surface 60*a* is wiped off by the second wiper 80*b*, the wiped ink may be transferred along the second wiper 80*b* and the base part 80*c* and attached to the first wiper 80*a*. In this case, when the ink attached on the ink receiving surface 28 is wiped off by the first wiper 80*a* having the ink attached thereto, the wiping performance is considerably deteriorated. Thus, as shown in FIG. 11, before performing the first wiping operation by the first wiper 80*a*, the first wiper 80*a* is located at the wiper cleaning position P3 and the contact surface 86 of the cleaning unit 34 is brought into contact to the first wiper 80*a*. That is, when receiving the maintenance command, the control unit 40 (refer to FIG. 2) controls the moving unit 84 to move the first wiper 80*a* to locate at the wiper cleaning position P3 before moving the first wiper 80*a* from the first wiping start position P1 toward the first wiping end position P2. When the first wiper 80*a* is located at the wiper cleaning position P3, the vacuum pump 96 (refer to FIG. 2) is driven.

FIG. 12 shows a state of the inkjet printer 10 when wiping off the ink attached on the ink receiving surface 28 by the first wiper 80*a*. As shown in FIG. 12, when wiping off the ink attached on the ink receiving surface 28 by the first wiper 80*a*, the ink receiving surface 28 is located at the second ink receiving surface position L2 and the discharge surface 60*a* is located at the second head position H2. The wiper unit 80 is moved by the moving unit 84 (refer to FIG. 2) such that the first wiper 80*a* is moved from the first wiping start position P1 to the first wiping end position P2 while contacting the ink receiving surface 28.

Figure 13:
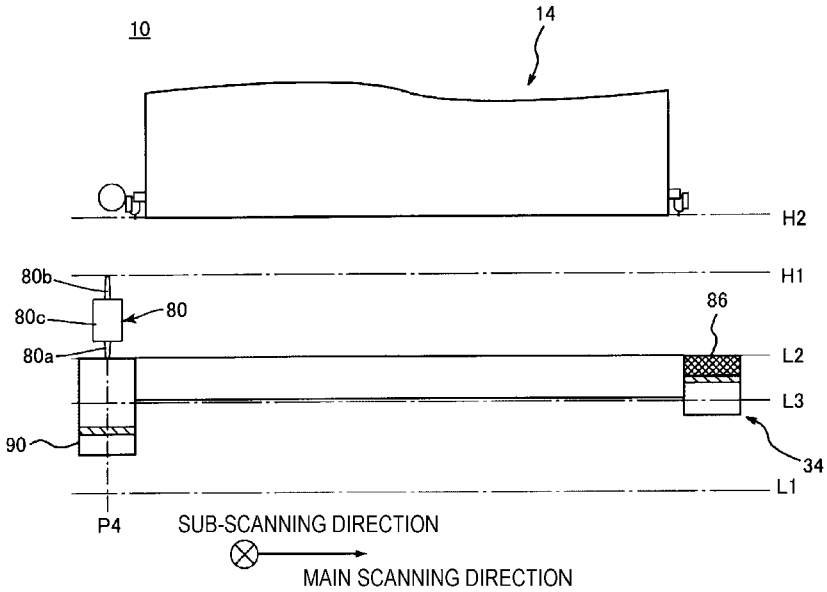
FIG. 13 shows a state of the inkjet printer when causing the ink attached on the ink receiving surface to flow into an ink receiving port.

FIG. 13 shows a state of the inkjet printer 10 when causing the ink attached on the ink receiving surface 28 to flow into the ink receiving port 90. As shown in FIG. 13, when causing the ink attached on the ink receiving surface 28 to flow into the ink receiving port 90, the wiper unit 80 is moved by the moving unit 84 (refer to FIG. 2) such that the first wiper 80*a* is moved from the first wiping end position P2 to the ink disposal position P4 while contacting the ink receiving surface 28. The control unit 40 shown in FIG. 2 controls the moving unit 84 such that the first wiper 80*a* is moved from the first wiping end position P2 to the wiper cleaning position P3 via the ink disposal position P4 defined by the ink receiving port 90. When the first wiper 80*a* is located at the ink disposal position P4, the vacuum pump 96 (refer to FIG. 2) is driven.

FIG. 14 shows a state of the inkjet printer 10 when the discharge surface 60*a* is covered by the cap 102. As shown in FIG. 14, when covering the discharge surface 60*a* by the cap 102, the ink receiving surface 28 is located at the capping position L4 and the discharge surface 60*a* is located at the first head position H1. The moveable part 38*c* of the cap peripheral wall member 38 is moved down by the peripheral wall elevating device 104, so that the lowest point of the peripheral wall part 38*a* of the cap peripheral wall member 38 is moved down and brought into contact with the contact surface 28*a* of the ink receiving member 30.

[Effects of Illustrative Embodiment]

As shown in FIG. 11, the first wiper 80*a* can be cleaned by the cleaning unit 34 just before starting the first wiping operation by the first wiper 80*a*. Therefore, it is possible to reduce a possibility that the ink is again attached to the first wiper 80*a* until the first wiping operation starts after the first wiper 80*a* is cleaned. Hence, it is possible to prevent the deterioration of the wiping performance.

As shown in FIGS. 10 and 11, the first wiper 80*a* is located at the wiper cleaning position P3 after the second wiping operation by the second wiper 80*b* and before the first wiping operation by the first wiper 80*a*. Therefore, even when the ink is attached to the first wiper 80*a* at the second wiping operation, it is possible to remove the ink by the cleaning unit 34.

As shown in FIG. 7, an image is recorded at a state where the first wiper 80*a* is located at the ink disposal position P4. Therefore, it is possible to start the image recording operation just after the ink is collected by the ink disposing unit 36 or while the ink is being collected by the ink disposing unit 36.

As shown in FIG. 2, in the cleaning unit 34, it is possible to efficiently clean the first wiper 80*a* by the capillary action on the contact surface 86 having a mesh shape.

[Other Illustrative Embodiments]

While the present invention has been shown and described with reference to certain illustrative embodiments thereof, it will be understood by those skilled in the art that various changes in form and details may be made therein without departing from the spirit and scope of the invention as defined by the appended claims.

As shown in FIG. 14, in the above illustrative embodiment, the ink receiving member 30 and the cap peripheral wall member 38, which are parts of the cap 102, are separately formed and the ink receiving surface 28 is formed on the upper surface of the ink receiving member 30. However, in another illustrative embodiment, the ink receiving member and the cap peripheral wall member, which are parts of the cap, may be integrally formed and the ink receiving surface may be formed on the upper surface of the ink receiving member. Also, in another illustrative embodiment, the cap and the ink receiving member may be separately formed and the ink receiving surface may be formed on the upper surface of the ink receiving member.

As shown in FIG. 1, in the above illustrative embodiment, the line-type printer is illustrated as an example of the liquid discharge apparatus. However, in another illustrative embodiment, the inventive concept of invention may be applied to a serial printer. Also, in the above illustrative embodiment, the inkjet printer is illustrated as an example of the liquid discharge apparatus. However, in another illustrative embodiment, the inventive concept of the invention may be applied to a liquid discharge apparatus such as facsimile and copier, other than the printer. Also, regarding the liquid discharge method, it may be possible to use a method of discharging the liquid by using a pressure when a volume of the liquid is expanded by a heat generating element, instead of the actuator method.

What is claimed is:

1. A liquid discharge apparatus comprising:

a liquid discharge head including a discharge surface having a plurality of liquid discharge nozzles formed thereon;

a liquid receiving surface configured to oppose the discharge surface to receive liquid discharged from the liquid discharge nozzles;

a first wiper configured to wipe liquid attached on the liquid receiving surface while being moved and contacting the liquid receiving surface;

a second wiper configured to wipe liquid attached on the discharge surface while being moved and contacting the discharge surface;

a moving device configured to move the first wiper and move the second wiper together with the first wiper;

a cleaning device configured to clean the first wiper;

a control device configured to control at least the moving device; and a maintenance command device configured to provide a maintenance command to the control device, wherein when the control device receives the maintenance command, the control device is configured to control the moving device to:

move the second wiper along a second plane while contacting the discharge surface, from a second wiping start position which is located at one end of the discharge surface to a second wiping end position which is located at the other end opposite to the one end of the discharge surface, subsequently move the first wiper to a wiper cleaning position defined by the cleaning device, and then move the first wiper along a first plane that is different from the second plane, while contacting the liquid receiving surface, from a first wiping start position which is located at one end of the liquid receiving surface to a first wiping end position which is located at the other end opposite to the one end of the liquid receiving surface, wherein the wiper cleaning position is aligned in a predetermined direction together with the first wiping start position and the first wiping end position and is located at an opposite side to the first wiping end position with respect to the first wiping start position, and a distance from the wiper cleaning position to the first wiping start position is smaller than a distance from the first wiping end position to the first wiping start position, and wherein the first wiping start position and the second wiping start position are located at a first side with respect to the liquid receiving surface in the predetermined direction, and the first wiping end position and the second wiping end position are located at a second side opposite to the first side with respect to the liquid receiving surface in the predetermined direction.

2. The liquid discharge apparatus according to claim 1, further comprising:

a liquid disposing device including a liquid receiving port which is configured to allow liquid received on the liquid receiving surface to flow therein to dispose the liquid, wherein the control device controls the moving device to move the first wiper from the first wiping end position to the wiper cleaning position via a liquid disposal position defined by the liquid receiving port, and wherein the liquid disposal position is aligned in the predetermined direction together with the first wiping start position, the first wiping end position and the wiper cleaning position, and is located at an opposite side to the first wiping start position with respect to the first wiping end position, and a distance from the liquid disposal position to the first wiping end position is smaller than a distance from the first wiping start position to the first wiping end position.

3. The liquid discharge apparatus according to claim 2, wherein the control device controls the moving device to locate the first wiper at the liquid disposal position when recording an image.

4. The liquid discharge apparatus according to claim 2, wherein the liquid disposing device includes:

a waste liquid accommodating chamber configured to accommodate therein waste liquid;

a first pipe allowing the liquid receiving port and the waste liquid accommodating chamber to communicate with each other; and a pump provided to the first pipe and configured to cause the liquid in the liquid receiving port to flow to the waste liquid accommodating chamber via the first pipe.

5. The liquid discharge apparatus according to claim 4, wherein the liquid disposing device further includes:

a second pipe allowing the cleaning device and a middle part of the first pipe to communicate with each other, and wherein the pump is provided at a side closer to the waste liquid accommodating chamber with respect to the middle part of the first pipe.

6. The liquid discharge apparatus according to claim 1, wherein the cleaning device includes a contact surface with which the first wiper is brought into contact, and the contact surface has a mesh shape.

7. A liquid discharge apparatus comprising:

a liquid discharge head including a discharge surface having a plurality of liquid discharge nozzles formed thereon;

a liquid receiving surface configured to oppose the discharge surface to receive liquid discharged from the liquid discharge nozzles;

a wiper device including a first wiper configured to move along a first plane to wipe liquid attached on the liquid receiving surface, and a second wiper configured to move along a second plane to wipe liquid attached on the discharge surface, the second plane being different from the first plane;

a moving device configured to move the wiper device in a moving direction;

a cleaning device configured to clean the first wiper;

a control device configured to control at least the moving device; and a maintenance command device configured to provide a maintenance command to the control device, wherein when the control device receives the maintenance command, the control device is configured to control the moving device to:

move the wiper device such that the second wiper is moved along the second plane while contacting the discharge surface from a second wiping start position which is located at one end of the discharge surface in the moving direction to a second wiping end position which is located at the other end of the discharge surface in the moving direction, subsequently, the first wiper is moved to a first wiping start position which is located at one end of the liquid receiving surface in the moving direction via a wiper cleaning position defined by the cleaning device provided at a same side as the first wiping start position with respect to the liquid receiving surface, and along the first plane while contacting the liquid receiving surface from the first wiping start position to a first wiping end position which is located at the other end of the liquid receiving surface in the moving direction, and wherein the first wiping starting position and the second wiping start position are located at a first side with respect to the liquid receiving surface in the moving direction, and the first wiping end position and the second wiping end position are located at a second side opposite to the first side with respect to the liquid receiving surface in the moving direction.

8. A liquid discharge apparatus comprising:

a liquid discharge head including a discharge surface having a plurality of liquid discharge nozzles formed thereon;

a liquid receiving surface configured to oppose the discharge surface to receive liquid discharged from the liquid discharge nozzles;

a first wiper configured to wipe liquid attached on the liquid receiving surface while being moved and contacting the liquid receiving surface;

a second wiper configured to wipe liquid attached on the discharge surface while being moved and contacting the discharge surface;

a moving device configured to move the first wiper and move the second wiper together with the first wiper;

a cleaning device configured to clean the first wiper;

a control device configured to control at least the moving device; and a maintenance command device configured to provide a maintenance command to the control device, wherein when the control device receives the maintenance command, the control device is configured to control the moving device to:

move the second wiper along a second plane while contacting the discharge surface, from a second wiping start position which is located at one end of the discharge surface to a second wiping end position which is located at the other end opposite to the one end of the discharge surface, subsequently move the first wiper to a wiper cleaning position defined by the cleaning device, and then move the first wiper along a first plane that is different from the second plane while contacting the liquid receiving surface, from a first wiping start position which is located at the liquid receiving surface to a first wiping end position which is located at the liquid receiving surface, wherein the wiper cleaning position is aligned in a predetermined direction together with the first wiping start position and the first wiping end position and is located at an opposite side to the first wiping end position with respect to the first wiping start position, and a distance from the wiper cleaning position to the first wiping start position is smaller than a distance from the first wiping end position to the first wiping start position, and wherein the first wiping start position and the second wiping start position are located at a first side with respect to the liquid receiving surface in the predetermined direction, and the first wiping end position and the second wiping end position are located at a second side opposite to the first side with respect to the liquid receiving surface in the predetermined direction.

* * * * *